United States Patent [19]

Richardson et al.

[11] Patent Number: 4,759,478

[45] Date of Patent: Jul. 26, 1988

[54] HINGED PLUG TYPE LID

[75] Inventors: Larry A. Richardson, Middletown; John G. Smith, Warwick; Robert L. Gordon, Monroe, all of N.Y.

[73] Assignee: International Paper Company, Purchase, N.Y.

[21] Appl. No.: 374,126

[22] Filed: May 3, 1982

[51] Int. Cl.[4] ..... B65D 51/18

[52] U.S. Cl. ..... 222/556; 220/254; 220/339; 222/143; 206/508

[58] Field of Search ..... 222/540, 544, 556, 143; 220/254, 355, 339, 380; 229/7 R, 17 M, 17 R; 206/509, 508

[56] References Cited

U.S. PATENT DOCUMENTS

| | | | |
|---|---|---|---|
| 2,164,816 | 7/1939 | Harris | 220/24 |
| 2,764,199 | 9/1956 | Tupper | 222/556 X |
| 2,833,452 | 5/1958 | Drummond et al. | 222/480 X |
| 2,906,439 | 9/1959 | Santuci | 222/183 |
| 3,262,606 | 7/1966 | Waterman | 222/153 |
| 3,469,732 | 9/1969 | Foster | 220/339 X |
| 3,542,235 | 11/1970 | Hidding | 220/29 |
| 3,756,493 | 9/1973 | Holmes | 229/5.5 |
| 3,912,128 | 10/1975 | Ziemann et al. | 222/541 |
| 4,059,201 | 11/1977 | Foster | 222/541 X |
| 4,170,724 | 10/1979 | Waterbury | 220/254 X |
| 4,280,636 | 7/1981 | Lewis | 222/565 |
| 4,402,451 | 9/1983 | Woerz et al. | 206/509 X |
| 4,420,093 | 12/1983 | Von Holdt | 206/508 X |
| 4,421,244 | 12/1983 | Van Melle | 206/508 X |
| 4,452,382 | 6/1984 | Von Holdt | 222/573 X |

*Primary Examiner*—Kevin P. Shaver
*Attorney, Agent, or Firm*—Walt Thomas Zielinski

[57] ABSTRACT

A container top closure integrally formed from plastic polymer material as by injection molding. The closure is adapted to be attached to the upper end of a container for granular or other pourable material. A single plastic member, such as polypropylene, or polyethylene, is provided with a dispensing opening, the opening having an integral skirt downwardly depending from three sides of its periphery, to define a first dispensing opening surface. A closure flap, integrally formed with the member which defines the top closure, carries two sealing surfaces which cooperate with complementary surfaces formed around the dispensing opening. The sealing surfaces provide increased moisture entrance resistance across the dispensing opening.

3 Claims, 1 Drawing Sheet

HINGED PLUG TYPE LID

BACKGROUND OF THE INVENTION

This invention relates to the container art and more particularly to a top dispensing closure adapted to be placed over the open end of a paperboard container. The top dispensing closure is suitably sealed or attached to the open end of the container and is adapted to dispense granular or other pourable material from a dispensing opening in the container top closure.

SUMMARY OF THE INVENTION

According to the practice of this invention, a container top dispensing closure is formed from polypropylene, polyethylene, or other plastic polymer material, the top closure being conveniently formed as by injection molding or thermoforming or the like. The closure exhibits great resistance to the entry of moisture or other undesirable contaminants to the interior of the container provided with the dispensing closure top construction of this invention. This is achieved by the use of extended and cooperating surfaces on both the periphery of the dispensing opening and on a closure flap adapted to seal the dispensing opening when the container is not in use.

The full nature of the invention will be understood from the accompanying drawings and the following description and claims.

DETAILED DESCRIPTION OF THE INVENTION

Figure 1:
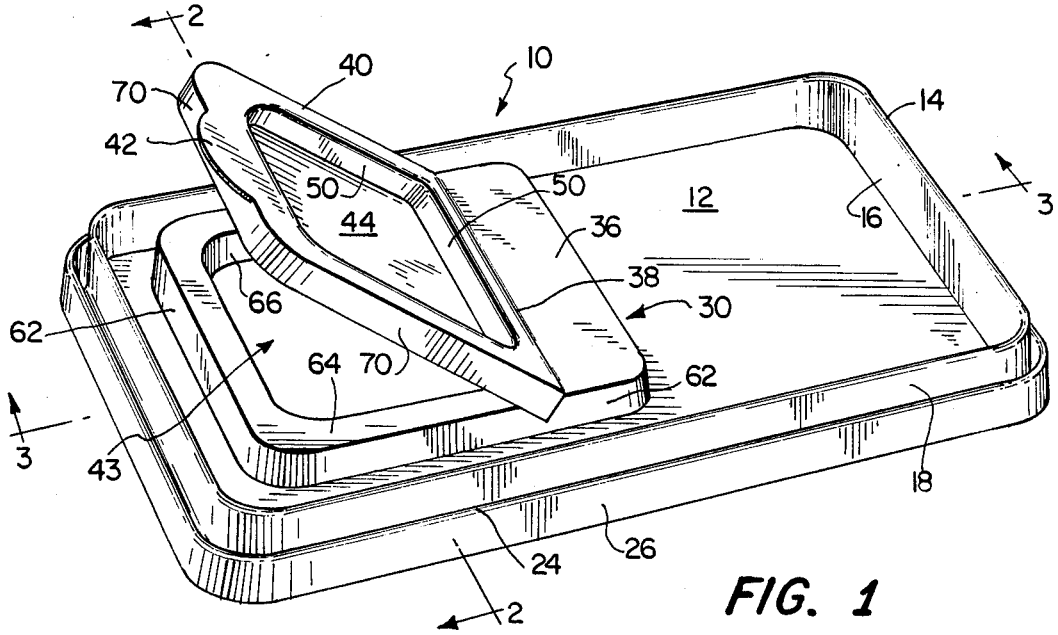
FIG. 1 is a perspective view of the top dispensing closure of this invention, showing the closure flap in a partially open position.
Figure 2:
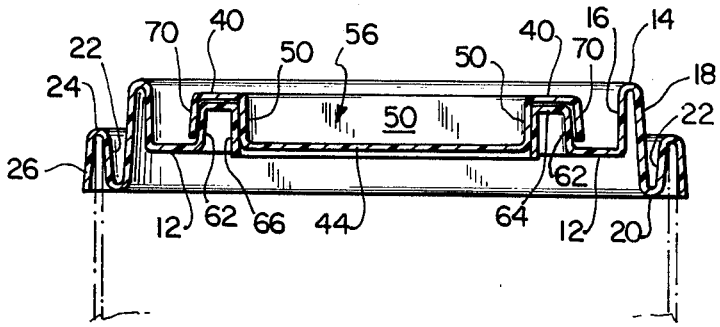
FIG. 2 is a transverse cross-sectional view taken along section 2—2 of FIG. 1, when the closure flap is in its closed position.
Figure 3:
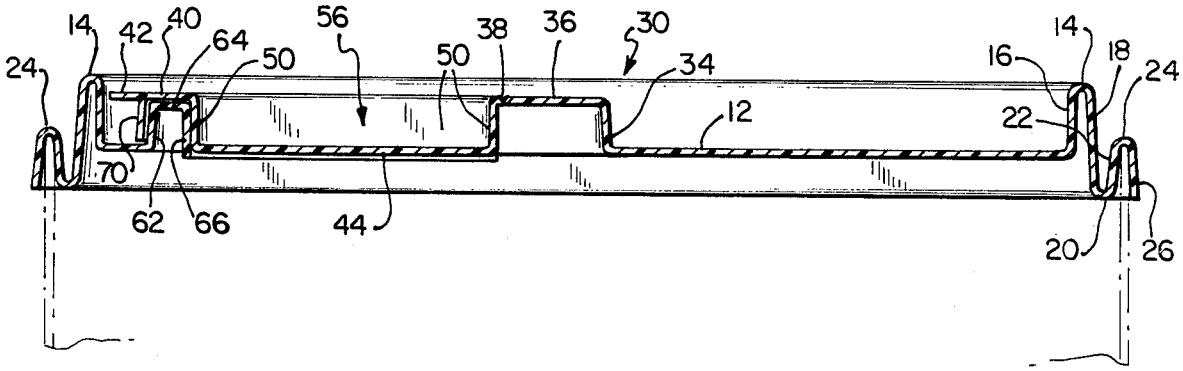
FIG. 3 is a longitudinal cross-sectional view taken along section 3—3 of FIG. 1, when the closure flap is in its closed position.

Referring now to the drawings, the numeral 10 denotes generally the top dispensing closure of this invention and is molded from polymeric material into a panel or major protion denoted by the numeral 12, which carries first and second radially disposed (with respect to the center of the closure) upstanding wall members here each in the form of a pair of parallel elements. The radially innermost wall member includes a bight portion 14 integrally connecting the uppermost portions of vertically disposed walls 16 and 18. In the radially outermost wall member, bight portion 24 connects vertically extending wall 22 with vertically extending wall 26. The radially innermost container walls define a stacking wall or abutment, as will later be described. The numeral 30 denotes generally an upstanding or raised platform-like assembly which is provided with a dispensing opening. The assembly 30 includes a right-hand (as viewed in FIGS. 1 and 3) wall portion 34 extending upwardly from panel 12. Wall 34 upwardly terminates in horizontally extending portion 36 which carries a hinged or pivoted closure flap, the flap being connected to portion 36 by means of hinge indentation 38. The numeral 40 denotes a horizontally disposed rim on the upper portion of the closure flap, the inner or central portion of the latter carrying a bottom wall 44 integrally joined to upstanding wall or skirt portions 50. There are four wall portions 50 which merge with top rim 40. A well, which may store coupons or other promotional materials, defined by wall portions 50 and bottom wall portion 44 is denoted generally by the numeral 56. A pull tab 42 is defined by an extension of horizontal rim portion 40. A dispensing aperture 43 (see FIG. 1) is defined by generally vertically extending wall 62 and skirt 66 joined by bight rim portion 64, portion 64 also lying in a horizontal plane. Wall portions 66 define a first sealing surface, while wall portions 50 define a second sealing surface. The outermost peripheral portion of horizontal rim surface 40 of the closure flap carrier an integral and downardly extending wall or skirt portion 70 on the three unhinged sides at the closure flap. Wall portions 62 define a third sealing surface, while wall portions 70 define a fourth sealing surface. As shown at FIGS. 2 and 3, skirt portion 70 is in surface contact with walls 62, while walls 50 are in surface contact with walls 66, the latter immediately surrounding dispensing opening 43 on three sides only. From FIGS. 2 and 3 the reader will observe that horizontal bight or rim portion 64 defines a fifth sealing surface, while corresponding bight or rim portion 40 defines a sixth sealing surface.

The operation of the closure is as follows. As indicated by the dashed lines in FIGS. 2 and 3, the radially outermost wall member sandwiches (between 22 and 26) and is sealingly secured by known techniques to the upper rim of a container, such as a container formed of polyethylene coated paperboard. The container may carry a granular or other pourable substance such as a food product. When closed, the closure flap inhibits the entry of moisture and other undesirable contaminants through dispensing opening 43 by virtue of the surface-to-surface contact defined by wall 70 bearing against wall 62, by wall 66 bearing against wall 50, and by wall or rim bight 64 bearing against wall or rim bight 40. The reader will readily visualize that a plug type sealing action is realized by the present construction at each of the three side wall portions of wall 66 by cooperation with wall portion 50 of the closure flap or closure plug. A similar plug type sealing construction is realized by the three radially outermost (as taken from bottom wall 44) wall portions 70 in cooperation with wall portions 62. For convenience in manufacture and ease in opening and flap closing, both the wall portion pairs 70-62 and 66-50 may be upwardly tapered.

The radially innermost wall member 14, 16, 18 defines a stacking abutment or flange. It is adapted to fit into a recessed container bottom, to thereby admit of stacking of identical containers.

The container that is used in connection with the top closure lid construction 10 described herein generally comprises a body portion made from a five-layer construction consisting of (from the outside in): polyethylene (P.E.)/paperboard (solid bleached sulfate)/P.E./-foil/P.E. Other laminate constructions can be utilized if necessary. For example, another such construction consists of P.E./paperboard/P.E. Yet another laminate construction, having medium barrier properties, consists of P.E./paperboard/P.E./P.E. The P.E. may vary in thickness from 0.5 to 1.5 mil, and it may comprise either low or high density P.E., or combinations thereof. Moreover, other plastics such as Surlyn, polypropylene, and the like may be substituted for, or used in conjunction with, P.E., depending upon the final barrier properties required. The paperboard layer may vary in thickness between 12 and 25 mils, and the aluminum foil is generally 0.00035 inches thick. It will be obvious that a laminate construction can be designed to meet varying barrier requirements. The bottom of the container is generally made from the same material as the side walls. In general, the plastic top closure construction 10 will be manufactured from a plastics material having a thickness varying between 15 and 30 mils, depending upon the strength and barrier requirements of the product packaged within the container. It will also be recognized that the containers may be manufactured in various shapes, i.e., round, oval, oblong, or "rectangular" with rounded corners. Since the body of the container is manufactured from a blank, no extra labeling is required since the blanks can be pre-printed.

Generally speaking, the present invention is directed to a container top closure integrally formed from plastic polymer material as by injection molding. The closure is adapted to be attached to the upper end of a container for granular or other pourable material. A single plastic member, such as polypropylene or polyethylene, is provided with a dispensing opening, the opening having an integral and annularly continuous skirt downwardly depending from its periphery, to define a first dispensing opening surface. A closure flap, integrally formed with the member which defines the top closure, carries two sealing surfaces which cooperate with complementary surfaces formed around the dispensing opening. The sealing surfaces provide increased moisture entrance resistance across the dispensing opening.

Although the invention has been described above by reference to a preferred embodiment, it will be appreciated that other constructions may be devised, which are, nevertheless, within the scope and spirit of the invention and are defined by the claims appended hereto.

What is claimed is:

1. A container top dispensing closure adapted to be placed on the open end of a paperboard or other container, the closure defined by a molded plastic member comprising a panel portion and an upstanding or raised platform-like assembly, said member having means at its periphery for sealing attachment to the open end of the container, said means comprising a pair of vertically disposed and spaced apart walls at the periphery of the member, the space between the walls adapted to sandwich and sealingly receive said open container end; a peripheral stacking wall comprising a pair of vertically disposed walls joined by a bight portion or top rim, said stacking wall positioned radially inwardly of said means for attachment to the open container end, the top rim of the stacking wall being higher than any other portion of the container top closure, and being integral therewith; a dispensing opening in the member, said dispensing opening being provided on said upstanding or raised platform-like assembly and being raised with respect to said panel portion of said member; a first skirt, the first skirt being integral with the member and extending downwardly from at least a major portion of the edges of the dispensing opening to thereby define a first sealing surface; a closure flap hingedly carried by and integral with the member, the closure flap hinged to the member adjacent the dispensing opening, the closure flap covering the dispensing opening in the closed position of the closure flap; a second skirt being integral with the closure flap, wherein the lowermost edges of said second skirt are closed by a bottom wall integral with the second skirt, to thereby define a well in the closure flap, the well adapted to contain coupons or other promotional material, the second skirt defining a second sealing surface, the first and second sealing surfaces being in surface-to-surface sealing contact with each other when the closure flap is in its closed position, whereby the surface-to-surface sealing contact increases moisture entrance resistance across the dispensing opening, movement of the closure flap upwardly about its hinge to an open position permitting dispensing through the dispensing opening.

2. The container top closure of claim 1 wherein the closure flap is hinged to the upstanding or raised platform-like assembly of the member around the dispensing opening.

3. The container top closure of claim 1 including a third sealing surface, the third sealing surface being spaced radially outwardly from the first sealing surface, being substantially parallel thereto, a fourth sealing surface, the fourth sealing surface being radially outwardly spaced from the second sealing surface and the third sealing surface and being carried by the closure flap, the third and fourth sealing surfaces being in surface-to-surface contact.

* * * * *